United States Patent [19]

Schulz

[11] 4,440,501

[45] Apr. 3, 1984

[54] METHOD OF AUTOMATIC ADJUSTMENT OF SELF-CONTAINED RADIO-CLOCK BY MEANS OF TIME MARK

[76] Inventor: Werner Schulz, Valentinianstr. 6, 6802 Ladenburg, DE, Fed. Rep. of Germany

[21] Appl. No.: 272,559

[22] Filed: Jun. 11, 1981

[30] Foreign Application Priority Data

Jun. 19, 1980 [DE] Fed. Rep. of Germany ..... 3022949
Mar. 25, 1981 [EP] European Pat. Off. ..... 81102235

[51] Int. Cl.[3] ..... G04C 11/02
[52] U.S. Cl. ..... 368/47; 368/202
[58] Field of Search ..... 368/47, 46, 51, 52, 368/55, 59, 185, 187, 201, 200, 202

[56] References Cited

U.S. PATENT DOCUMENTS 3,772,258 3/1973 Besson et al. ..... 368/47
3,852,953 12/1974 Mischiatti ..... 368/47
4,014,166 3/1977 Cateora et al. ..... 368/47
4,114,363 9/1978 Imamura ..... 368/201
4,117,661 10/1978 Bryant, Jr. ..... 368/47
4,128,991 12/1978 Robert-Grandpierre ..... 368/51
4,204,167 5/1980 Lim ..... 368/47

FOREIGN PATENT DOCUMENTS 540521 9/1973 Switzerland .

OTHER PUBLICATIONS

Funkschau, 1979, Copy 26 pp. 99–103 "Funkyhr Mit Mitternachsvetekektor."

*Primary Examiner*—Bernard Roskoski
*Attorney, Agent, or Firm*—Michael J. Striker

[57] ABSTRACT

A time measuring method is combined with an automatic rate correction process in a digital or quasianalog clock; a clock rate deviation is repeatedly measured, in a predetermined lock-in-range, derived from the clock oscillator frequency, by means of a time mark received from a transmitter; the deviation data are stored and used for correcting the clock rate and the oscillator frequency whereby the stored data are maintained until the arrival of the next time mark.

6 Claims, 10 Drawing Figures

METHOD OF AUTOMATIC ADJUSTMENT OF SELF-CONTAINED RADIO-CLOCK BY MEANS OF TIME MARK

BACKGROUND OF THE INVENTION

This invention relates to a method of and a device for adjusting a clock by a time mark. The clock can be a digital clock or a clock indicating in quasi-analog manner with the help of a stepping motor, and that—apart from the first installation or a service—it never needs an adjustment, even after a long operational period during which a time mark is missing, and does not have a distinguishable speed- or rate deviation. The clock according to this invention works accurately under extreme interference and is power-saving.

The term "self-contained" radio-clock in this disclosure means an automatically working radio-clock which is independent of a manual adjusting process. The term "time mark" denotes a part of a modulation envelope that is transmitted by wire or wirelessly to indicate the time reference signal given by a transmitter (FIG. 9). The term radial-clock denotes a clock receiving the time mark. The term "clock radial" denotes a clock with a radio set.

The known methods of adjusting radio-clocks can be divided into three categories: 1. synchronization, 2. triggering, 3. demodulation and direct indication of a coded time information. For all these methods there are numerous variations and circuits including the necessary backup time, and a great number of publications are available. The first category includes analog or digital clocks whose internal time base is constantly or partly corrected in relation to a received reference frequency by means of automatic frequency control or phase comparison, as e.g. described by Tetzner, Karl: "Funksynchronisierte Uhren" in: Funkschau 1976, vol. 15, p. 623 (Franzis-Verlag München, Federal Republic of Germany) or by Marti, Raymond: "Selbsttätige und fortlaufende Zeiteinstellvorrichtung einer Uhr" in German published patent application (Auslegeschrift) DE-AS 1,773,406. There are also applications known that derive the time base of the clock from the carrier frequency of one (or several) transmitter(s). In this case an additional change-over to a second time base is required (backup time), as described by Schreiber, Herrmann: "Steuerung einer Gebrauchsuhr durch Zeitzeichensender" in Funkschau 1977, vol. 2, p. 96 and vol. 3, p. 137 (Franzis-Verlag München, Federal Republic of Germany). The second category includes digital clocks that work independently with a varying amount of accuracy and that are set at nominal value at a fixed time (mostly 0 o'clock) by means of a time mark, as e.g. described by Beck, J.: "Korrekturautomatik für Digitaluhren" in Elektor 1974, vol. 7, p. 79 (Elektor Verlag GmbH Gangelt, Federal Republic of Germany). The third category divides into two methods: 3.1 the time code transmitter is constantly received, as e.g. described by Weiss, Reinhard: "Uhrzeit- und Normalfrequenzempfänger für DCF 77 mit Gangreserve" in: Funkschau 1976, vol. 22, p. 964 (Franzis-Verlag München, Federal Republic of Germany), 3.2 the time code transmitter only temporarily serves for adjusting the radio-clock, as e.g. described by Prof. Dr.-Ing. Hilberg, Wolfgang: "Funkuhr-Einstellung" in the published German patent application (Offenlegungsschrift) DE-OS No. 2,715,096; in this case, the switching-on of the receiver is dependent on the rate of the clock, and the exceeding of the backup time is indicated; or the method of Mukaiyama, Fumiaki, Suwa, Nagano: "Automatisches Korrekturverfahren für eine elektronische Uhr", according to the published German patent application (Offenlegungsschrift) DE-OS No. 2,539,224, where the codedly transmitted time information serves as correction value for the digital clock at optional instants. The third category also includes receivers, e.g. television sets, that are not radio-clocks primarily but indicate the correct time after pressure on a push-button, as e.g. developed by AEG-Telefunken and described in the magazine "Elektrotechnik" vol. 6, 1972, p. 29 (Vogel-Verlag KG, Würzburg, Federal Republic of Germany) and under the title: "Künftig nur noch Atomzeit". Parallel to these there are various time measuring methods that define the rate of a clock by means of a transmitter signal and eliminate it by special provisions, as e.g. described by Maire, Bernard, Marin: "Elektronisches Zeitmessgerät mit automatischer Korrektur der Gangabweichung" in the published German patent application (Offenlegungsschrift) DE-OS No. 2,851,223; in this case, the rate of a clock in second steps is manually measured by means of a time mark over a long time interval, and then stored; the clock automatically corrects its stored rate within the next, same time intervals as long as a new correction invitation is signalized to the set user.

The methods mentioned have different advantages and disadvantages of which only the disadvantages to be emphasized are enumerated here: as to the 1st category: relatively long turn-on time of the receiver, which raises the susceptibility and the required energy; relatively short backup time; no self-contained operation in the original sense. As to the 2nd category: relatively inexact time indication after a longer missing time mark, because the rates of the subsequent, not corrected time intervals add up continuously; triggering is at 0 o'clock (counter reset) which makes it impossible to tune out interferences occurring regularly at that time. As to the 3rd category: a time code transmitter with a sufficient field intensity must be receivable which presupposes relatively elaborate and expensive receiving devices; the decoder circuits are relatively elaborate; the mounting of quasi-analog indicating clocks is not possible. Besides the manual operation, the aforedescribed time measuring method has the disadvantage that the rate of the clock reaches a relatively high value before correction begins.

SUMMARY OF THE INVENTION

A general object of the present invention is to overcome the aforementioned disadvantages. More particularly, an object of this invention is to provide a fourth category of radio-clocks which presents a combination of a time measuring method for the rate of the clock with an automatic adjusting process typical for radio-clocks, the result of which is a self-contained operation.

According to the method of this invention, the rate deviation of the clock is measured both as to its magnitude and its direction by means of a time mark with defined equal time intervals, the deviation is stored and then used for the correction of the rate and the oscillator frequency of the clock. The turning-on of the time signal receiver, the fixing of the lock-in range for the time mark, as well as the decoding of the time mark is also performed by this oscillator frequency. In spite of a very short turn-on time of the time-signal receiver, the lock-in range must be chosen wide enough to ensure that the time mark is within the limit value, even under the worst operational conditions. After a missing time mark, a false measurement and false correction is inhibited. In this case, the aforementioned correction is performed with the latest values stored, the result of which is a high backup time. Furthermore, the method has been worked out to be applicable for various clock installations. In this case, the master clock can, among other things, be regarded as amplifier stage for the time mark, providing all slave clocks with an amplified time mark. Provided that there is a uniform time-signal transmitted by all radio and TV stations, time code stations and master clocks, the time-signal receiver can automatically adjust to the transmitter with the highest field intensity, and can select another transmitter after repeated missing time mark. Likewise a displacement of the time-signal receiver into commercial radio and TV sets is possible, so that the already existing receiving device can be used by the radio-clock as well (FIGS. *6a, 6b*).

The invention presents the following advantages: 1. the maximum rate can be kept smaller than the display resolution; 2. the backup time is very high; 3. the method can be applied to digital clocks as well as to quasi-analog indicating clocks; 4. the time-signal receiver is turned on periodically for very short moments, the result of which is a very high freedom from interference and 5. energy economy; 6. the correction of the indicated value need not necessarily be at 0 o'clock; 7. the method can be applied to clock installations; 8. at the clock manufacturing the oscillator alignment can be avoided.

Provided a uniform time-signal (e.g. as in FIG. 9) which can be established and transmitted by far less problematically than a coded time information, further advantages can be provided: 9. the decoder circuits are laid out comparatively simple and can be produced in large numbers of pieces; 10. it is possible to displace the time-signal receiver into commercial radio and TV sets, so the already existing receiving device for this equipment can be useful for the radio-clock as well (FIGS. *6a, 6b*); moreover the radio-clock can be produced more cheaply; 11. the time-signal receiver can be produced less expensively than a receiver for coded time information because 11.1 a larger field intensity can be counted on (receiver locks in place to transmitter with highest field intensity); 11.2 the decoder circuit is more simple; 11.3 higher demodulation distortion is admissible; 11.4 the power supply can be smaller.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

DESCRIPTION OF THE PREFERRED EMBODIMENTS

Figure 1:
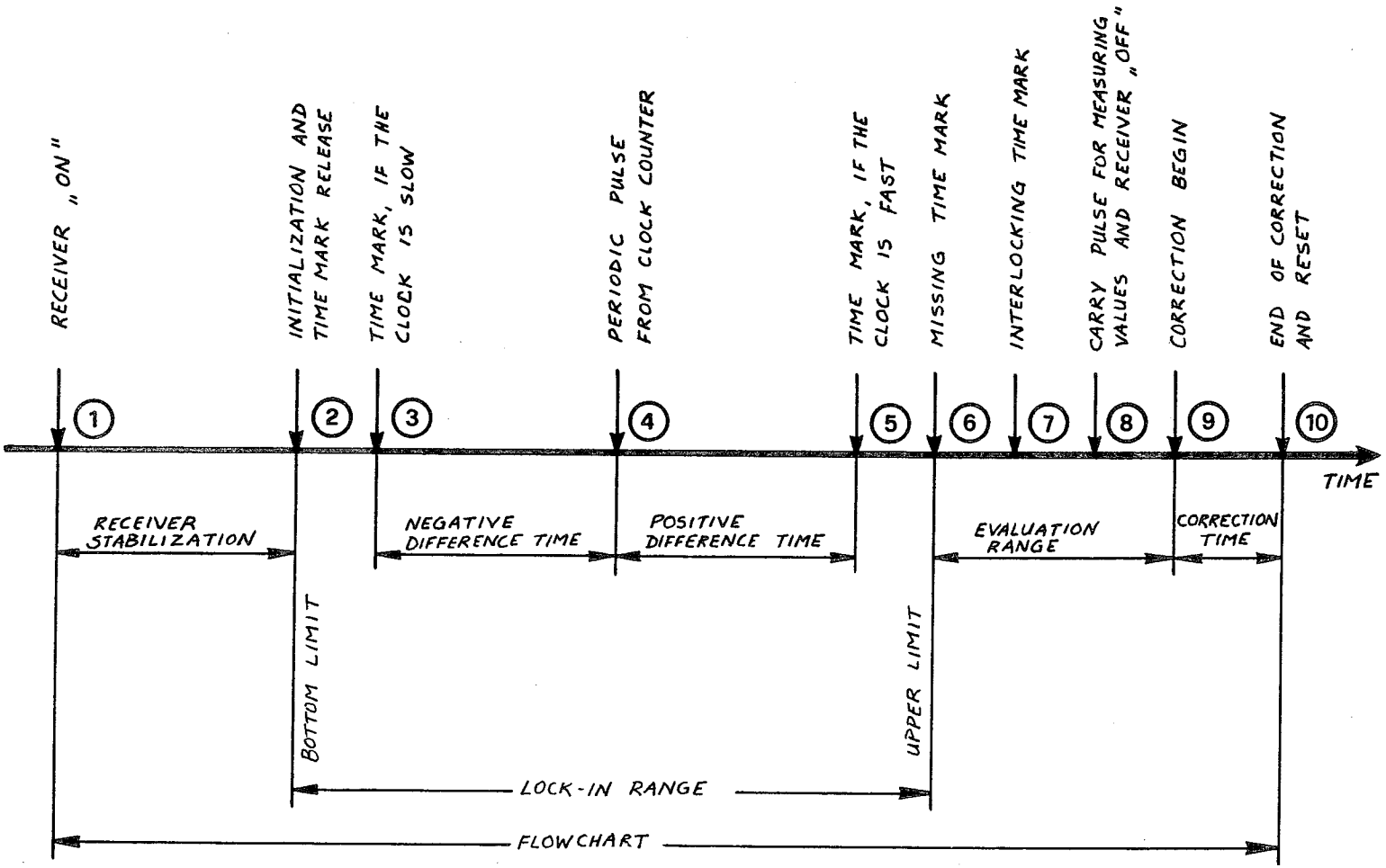
FIG. 1 shows in a flow chart the method of this invention.
Figure 2:
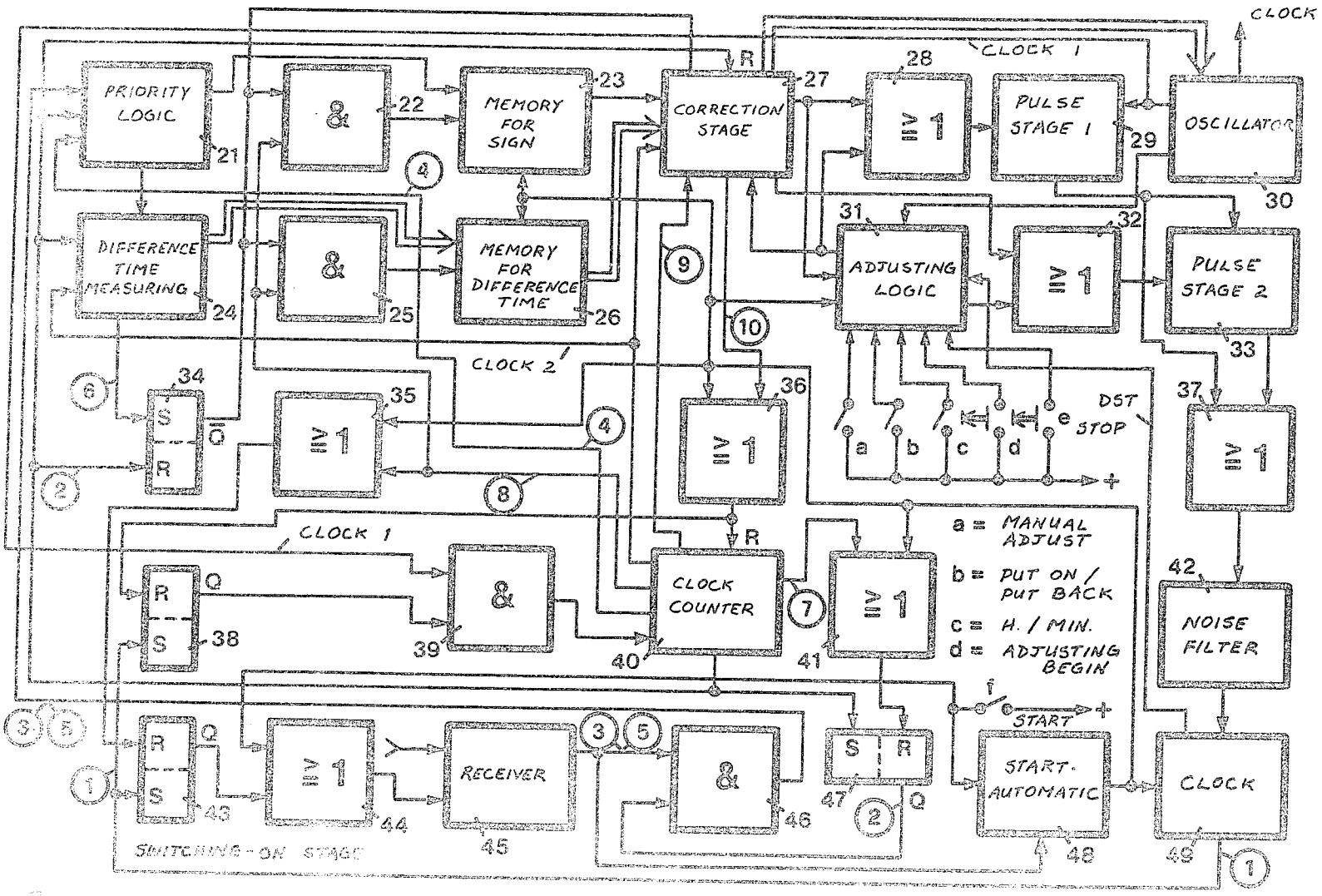
FIG. 2 shows in a block diagram the functional sequence of FIG. 1.

The flow chart in FIG. 1 shows the time sequence of the most important signal conducting lines of the block diagram in FIG. 2. These signal conduits are denoted by encircled reference numerals corresponding to those in FIG. 2. This block diagram is intended merely for illustrating the function of this invention and in practice is substituted by a computer program. The rate of the clock 49 is determined by the frequency stability of the oscillator 30. In order to measure this rate, a comparison with a supposedly "correct" time interval must be possible. As there is no absolutely correct time scale, the basis for clock applications has to be the legal time transmitted by non-uniform time-signals by radio and television stations and time code transmitters. The following disclosure supposes, however, that a uniform automatically evaluable time-signal is transmitted by all radio and television stations, so that the method described here can fully take effect.

Figure 3:
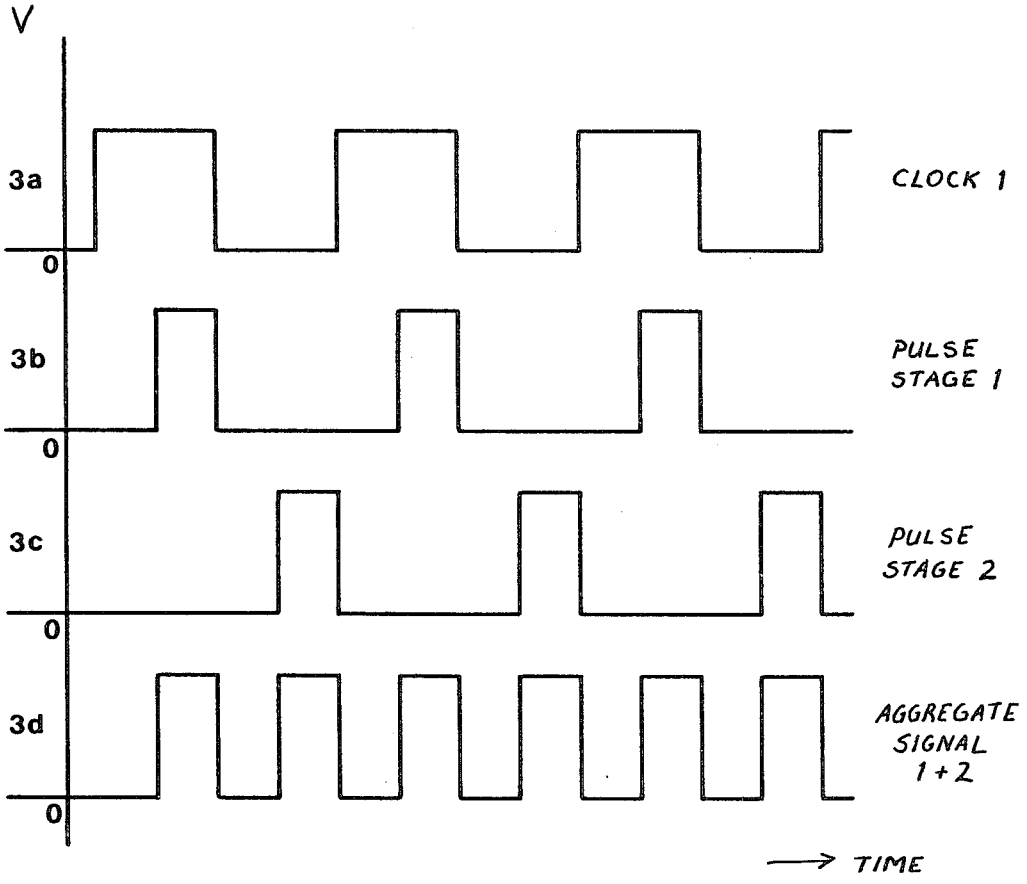
FIG. 3 shows the time diagram of the indication correction.

The clock is put into operation by means of the switch f that turns on the start-automatic 48 and the time-signal receiver 45. In case the clock is in operation it can be stopped by means of the stop-pushbutton e. For quasi-analog indication clocks, the hand setter is set to the time reference or held at that position. The next time mark 3 or 5 gets into the clock via the start-automatic 48 and adjusts all registers—according to the time reference given—to the desired value, and starts the time counter. Now the clock 49 works automatically without any influence of the transmitter with the accuracy of its quartz-oscillator until the arrival of the subsequent time mark 3 or 5. Parallel to the first time mark 3 or 5 received, the quiescent state is produced via the reset path of the start-automatic: the flip-flop 47 is reset via the OR-gate 41, which interlocks the time mark output of the AND-gate 46; the clock counter 40 is brought to O and the flip-flop 38 is brought to a rest position via an OR-gate 36, so that clock signal 1 cannot get into a clock counter 40 via an AND-gate 39; a switching-on stage 43, 44 of the time-signal receiver 45 is brought to the "off"-position via an OR-gate 35; further, the registers in the adjusting logic 31 are set to the desired value, and the contents of the memory for sign 23 and of the memory for difference time 26 are brought to 0. A short time later, the time-signal receiver 45 and the start-automatic 48 are turned off by means of the switch f which ends the start. A temporal preselection signal 1 of the clock 49 turns on the time-signal receiver 45 via the switching-on stage 43, 44, (e.g. after 23 h. / 59 min. / 50 s.) and opens the AND-gate 39 by means of the flip-flop 38, so that clock signal 1 can get into the clock counter 40. The next in time signal 2 is given by the clock counter 40, and releases the time mark output of the time-signal receiver 45 via the flip-flop 47 and the AND-gate 46, resets the registers in the difference time measuring stage 24 and in the priority logic 21, and releases via the AND-gates 22, 25 the carry of information from priority logic 21 and difference time measuring stage 24 to the memory for sign 23 and the memory for difference time 26. The priority logic 21 now accepts the time mark 3, 5, or the periodic pulse 4 from the clock counter 40. In case the periodic pulse 4 arrives before the time mark 5, there is a positive sign in the priority logic 21 (the signal for the memory for sign e.g. has the potential H); in the opposite case, there is a negative sign by definition (the signal for the memory for sign e.g. has the potential L). At the arrival of the 1st signal 3 or 4, the difference time measuring stage 24 is started by the priority logic 21 whereby counting pulses of clock signal line 2, leading from the clock counter 40 to the difference time measuring stage 24 and to the correcting stage 27, are counted and determine the resolution of the time measuring stage for the rate of the clock 49. The difference time measuring is then ended by the last arriving signal 4 or 5 via the path of priority logic 21. The signal 7 of the clock counter 40 then interlocks the time mark 3, 5 via OR-gate 41, flip-flop 47, and OR-gate 46. The next output 8 of the clock counter 40 turns off the time-signal receiver 45 via OR-gate 35, flip-flop 43, and OR-gate 44, and with the same signal 8 transmits the measuring values from priority logic 21 and difference time measuring stage 24, via the OR-gates 22, 25 into the memory for sign 23 and the memory for difference time 26. When these data are stable at the correction stage 27 and have been evaluated, the correction can be initiated from the clock counter 40 via the signalling line 9. The indication correction is performed by means of the pulse stage (1) 29, pulse stage (2) 33, and the OR-gate 37 in a way that the rate values stored in the memory for sign 23 and the memory for difference time 26 are cancelled. Hereby the pulse stage (1) 29 converts clock signal 1 (FIG. 3*a*) of the oscillator 30 into a square-wave of the impulse ratio 4 (FIG. 3*b*). In normal operation, this square-wave reaches the clock 49 as a clock signal via the OR-gate 37 and the noise filter 42. If, according to the measurement result, the clock 49 is fast, the latter clock signal is inhibited by the correction stage 27 via the OR-gate 28 in the pulse stage (1) 29, until the measured rate is compensated. If, according to the measurement result, the clock is slow, a center pulse relative to the clock signal (FIG. 3*c*) is released by the correction stage 27 via the OR-gate 32, in the pulse stage (2) 33 whereby the aggregate signal with the impulse ratio 2 (FIG. 3*d*) reaches the clock 49 via the OR-gate 37 until the measured rate is compensated. Parallel to the indication correction it is advisable to perform the oscillator correction, e.g. the digital correction, as described by Dipl.-Ing. Gollinger, Wolfgang, in: "Elektronische Quarzuhr mit integrieten Schaltungen" in published German patent application (Offenlegungsschrift) DE-OS No. 2,362,470 of Dec. 15, 1973 and schematically illustrated in FIG. 5. The correction stage calculatingly counteracts to the rate of the clock 49 in this oscillator path, so that there is a closed control loop. The end of all correction processes is indicated by the correction stage 27 by means of a signal 10 which effects the reset of the clock counter 40 and the flip-flop 38 via the OR-gate 36. In the event of a missing time mark, the counter in the difference time measuring stage 24 reaches its maximum value and sets the flip-flop 34 with its output or overflow 6. By this, the carry pulse 8 has no effect, so that the following indication correction is performed on the basis of the values lastly stored in the memory for sign 23 and the memory for difference time 26. The oscillator correction is inhibited by the flip-flop 34, so the automatic control system is interrupted in order to preserve the high backup time. The signalling line DST (daylight saving time) from the clock 49 to the adjusting logic 31 presupposes a computer-regulated date clock. H-potential corresponds e.g. to summer time, L-potential to winter time. The potential variation on this signalling line produces the aimed adjusting process of one hour respectively by means of the aforedescribed method for indication correction. As this adjusting process takes a relatively long time, and the indication information is incorrect during this time, the display resolution should be one second in any case in order to make visually noticeable the following information: the clock is too fast, or the clock is not in operation. This signalling is sufficient for outsiders, even without operating instructions, to disregard the display.

Most susceptible to interference is the time mark 3, 5, whose signal line is subjected to a closer study. Interference pulses outside the lock-in range (FIG. 1) have no effect whatsoever. Interference pulses within the lock-in range only have an effect if they arise before the arrival of the time mark 3 or 5. In this case, there is a high probability of a continuous interference, i.e. a high probability of an interference impulse sequence ranging over the whole lock-in range. Here, only the first interference pulse being nearest to the bottom limit (FIG. 1) has an effect. Hence it is simulated that the clock is slow. If, during the automatic oscillator alignment, provisions are made for the clock to be really slow, then the lock-in range—in spite of misinterpreted time marks—will not shift too far even after repeated interferences. In other words: the time mark 3 is expected within the first half of the lock-in range; whereby the interference pulse has only little action time. It must be regarded that the lock-in range with the periodic pulse 4 from the clock counter 40 changes in relation to the time mark 3, 5, whereas the time mark itself 3, 5 can be regarded as stationary.

Figure 4:
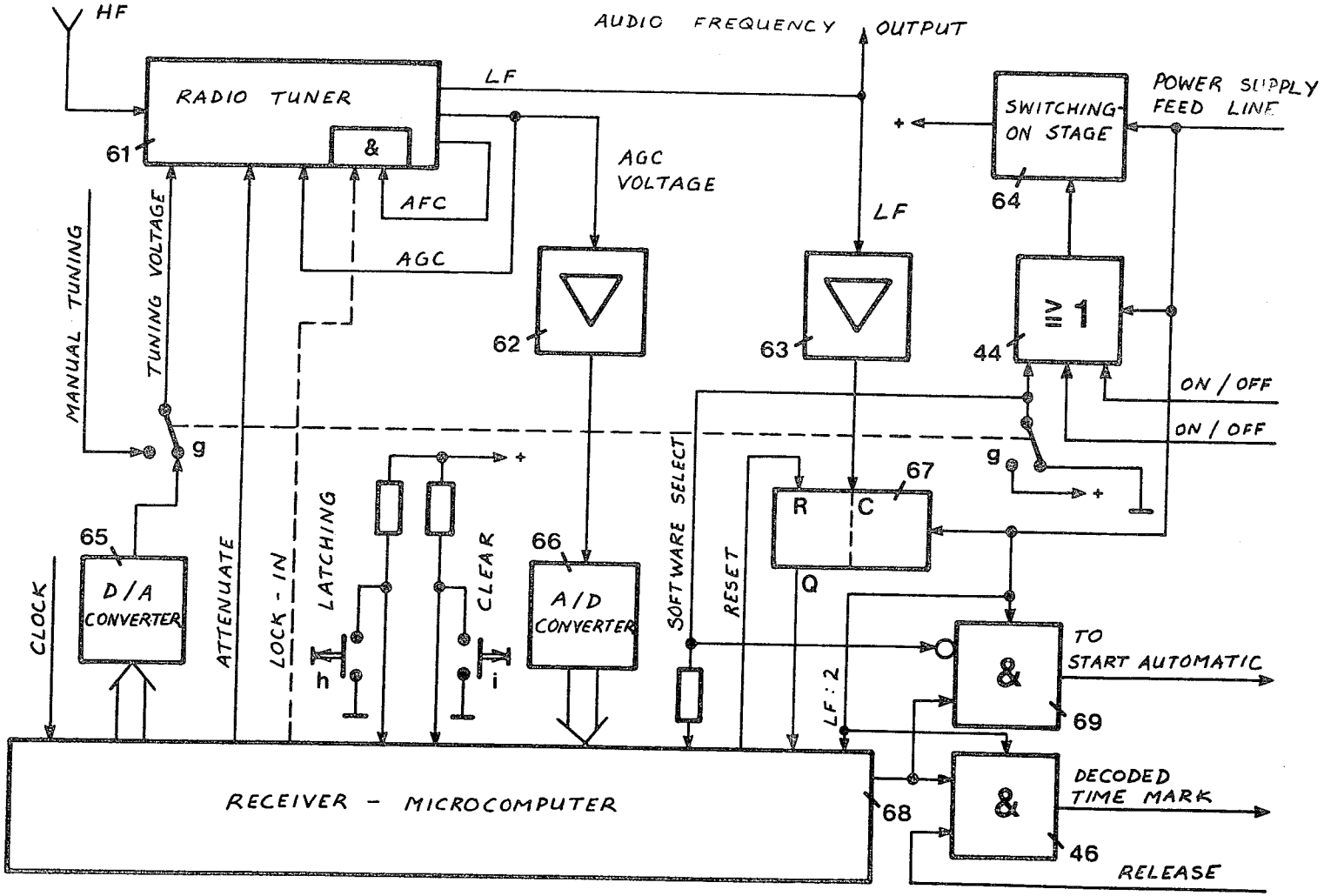
FIG. 4 shows a block diagram of the time-signal receiver.

FIG. 4 shows a detailed block diagram of the time-signal receiver 45. The radio tuner 61—as described before—has a simple design. The transmitter tuning is controlled by voltage. The receiver-microcomputer 68 automatically sets the radio tuner 61 to the transmitter of the highest field intensity after the switching-on by the OR-gate 44 and the switching-on stage 64. This is e.g. done by evaluating the AGC voltage supplied to the receiver-microcomputer 68 via the amplifier 62 and via the A/D-converter 66. First the computer program checks the whole received frequency range by means of the tuning voltage transformed by the D/A-converter 65 and stores the respective AGC voltage values. Then it locks the radio tuner 61 at the transmitter having the highest field intensity in order to increase the probability of a trouble-free reception. If, as is done now, the time-signal is transmitted at nearly each full hour by all transmitters, there is the possibility—in time information border areas—of receiving an adjacent transmitter outside the time information border, which is not possible with transmitted coded signals. The receiver-microcomputer 68 can simply register a repeated missing time mark, as it also has to perform the time mark decoding. In this case, it searches the transmitter of the second highest field intensity.

If the radio tuner 61 is to be used as a clock radio at the same time, a changeover to manual tuning by means of the switch g is advisable. The then tuned-in transmitter is now used as a time mark transmitter as well. In this operating mode, the start-automatic 48 must be interlocked via the OR-gate 69, and the receiver-microcomputer 68 must be changed over to a different software loop. There may be the necessity of selecting the time mark transmitter by manually tuning-in a certain transmitter (e.g. time code transmitter). This transmitter selection can then be stored by actuating the pushbutton h which ensures that the receiver-microcomputer 68 will then automatically select this transmitter. Pushbutton i can cancel this operating mode: if the program registers a 0 when sensing the memory location for the given transmitter, it then selects the transmitter of the highest field intensity. The time-signal LF to be decoded (FIG. 9) is amplified by the amplifier 63 and becomes high enough to be used as square-wave with defined logic levels. The flip-flop 67 improves the decodability, as it halves the mark frequency, and provides an exact impulse ratio of 2.

Figure 5:
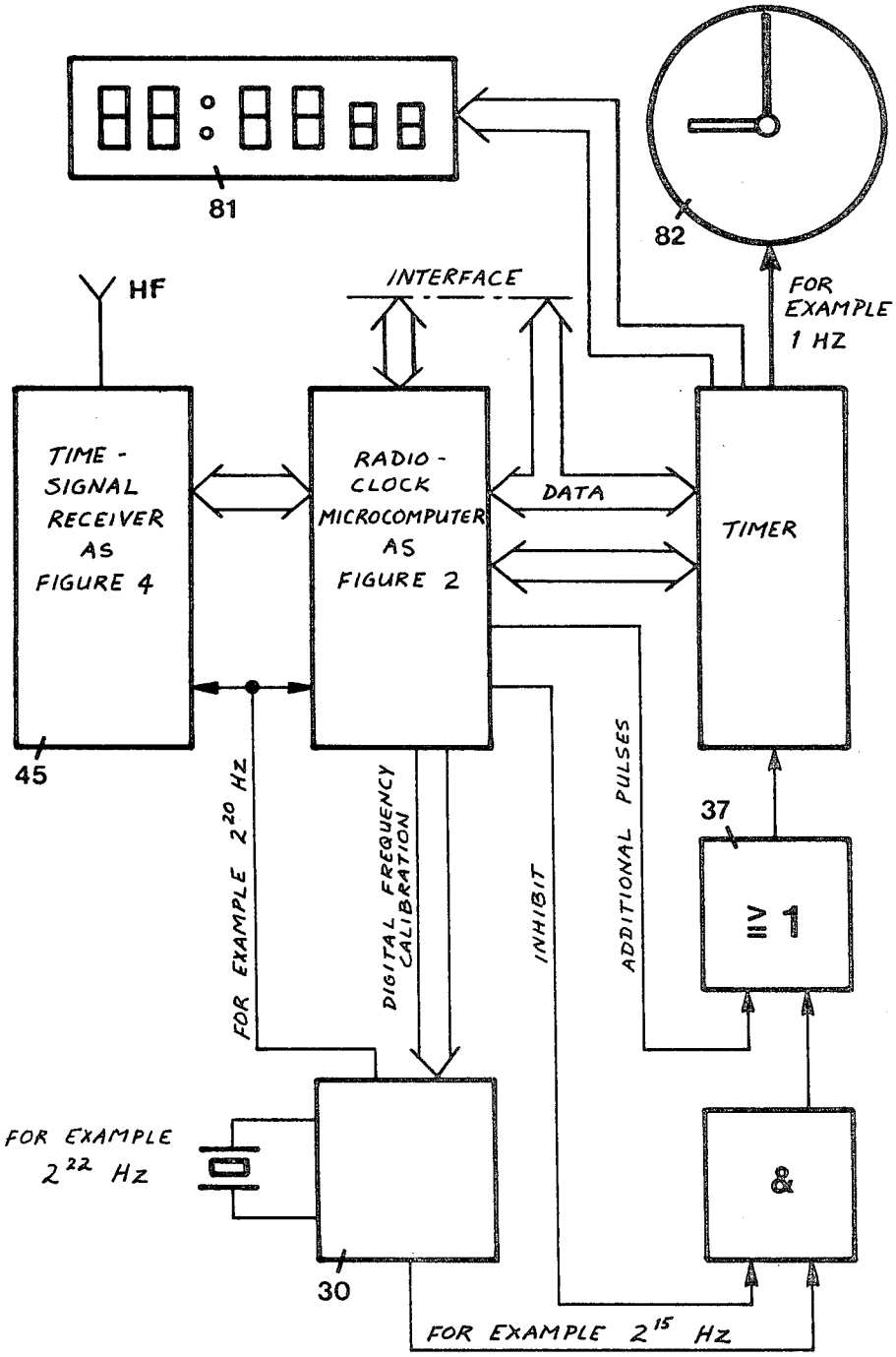
FIG. 5 shows schematically a complete concept of the radio-clock according to this invention.
Figure 6A:
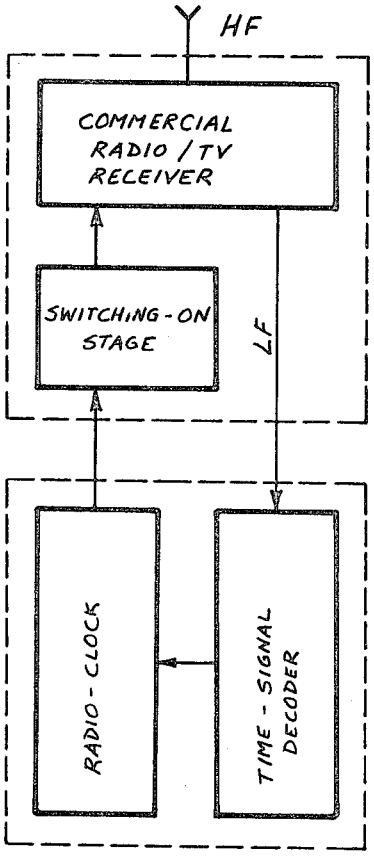
FIGS. 6A and 6B shows the displacement of the time-signal receiver in commercial radio and television sets.
Figure 6B:
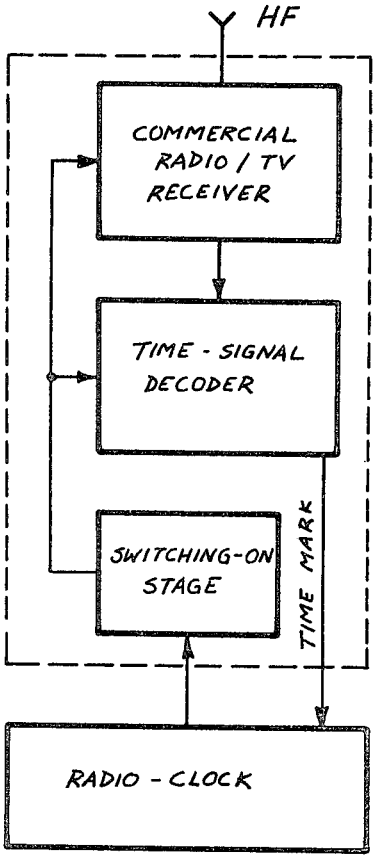

The application of the method of this invention for clock installation is as follows:

The most simple and least expensive embodiment of a clock installation according to this method includes a master clock according to FIG. 5, and quasi-analog indicating slave clocks with stepp motors 82. The controlling of the slave clocks is done by a single signalling line that leads the second step with correction to each slave clock. So the installation of the slave clocks is restricted to one twin wire—without power supply—, which recommends this method for applications where explosion hazards exist.

Figure 7:
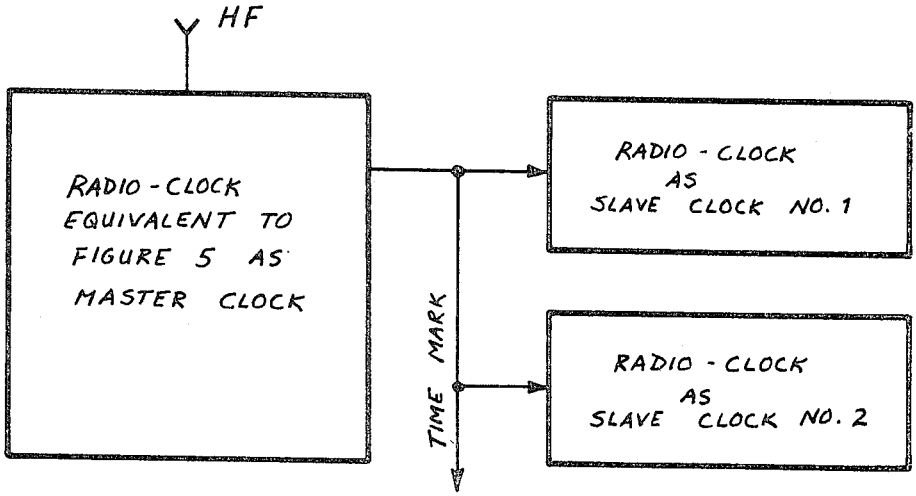
FIG. 7 shows the principle of function of a clock installation according to the invention.
Figure 8:
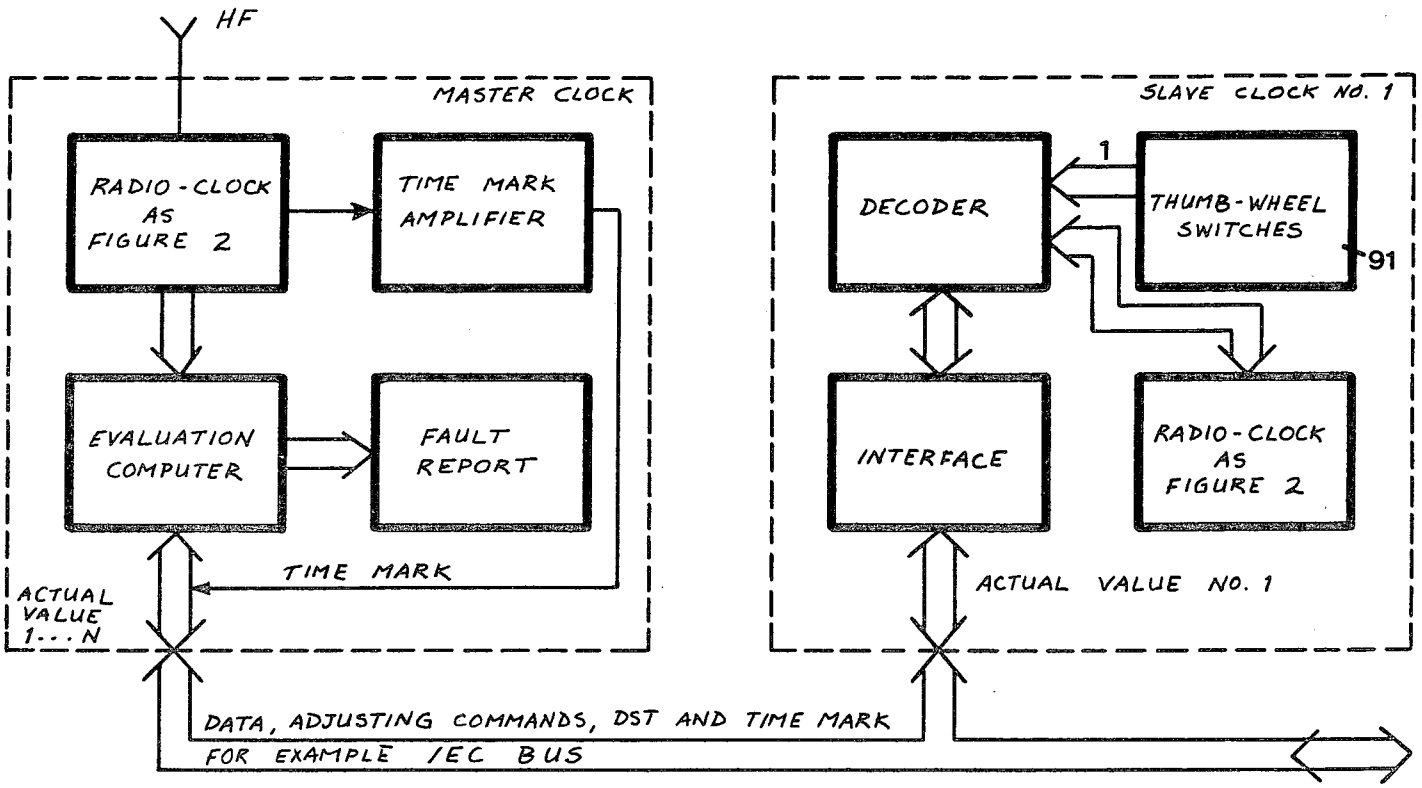
FIG. 8 shows schematically another embodiment of the clock installation according to the method invented.

Similarly simple is the embodiment of a clock installation according to FIG. 7. The master clock is worked out as in FIG. 5, and so are the slave clocks; the latter, however, have no time-signal receiver 45. The controlling of the slave clocks in this embodiment is done by means of the time mark. As a consequence, the slave clocks work trouble-free, need no adjustment after a master clock failure (exploitation of high backup time) and can be equipped with a digital display 81. Very often slave clocks are installed in places hard to get at and exposed to extreme environmental influences; so the service should be easy for this type of clock in particular. As the method of this invention presupposes a computer-directed clock anyway, it is possible, without any additional elaboration, to provide for outputs for the data exchange (the indicated value) via standardized interfaces between master clock and slave clocks. FIG. 8 shows an example, where the controlling of the slave clocks is done again by means of the time mark, resulting in trouble-free operation with a high backup time; moreover, there is the additional possibility of indicating, in a central control station, the defective operation of a slave clock by the cyclic checking of all slave clocks. After a performed service, a precision adjusting process derived from the master clock is also possible. The requisite condition for this process is the possibility of addressing each slave clock from the master clock, and the simple setting and recognition of the specific addresses in the slave clock. In accordance with this invention, this problem can be solved comparatively easily by means of thumbwheel switches 91 (FIG. 8). Then there is the possibility of performing adjusting process for DST coming from the master clock.

Figure 9:
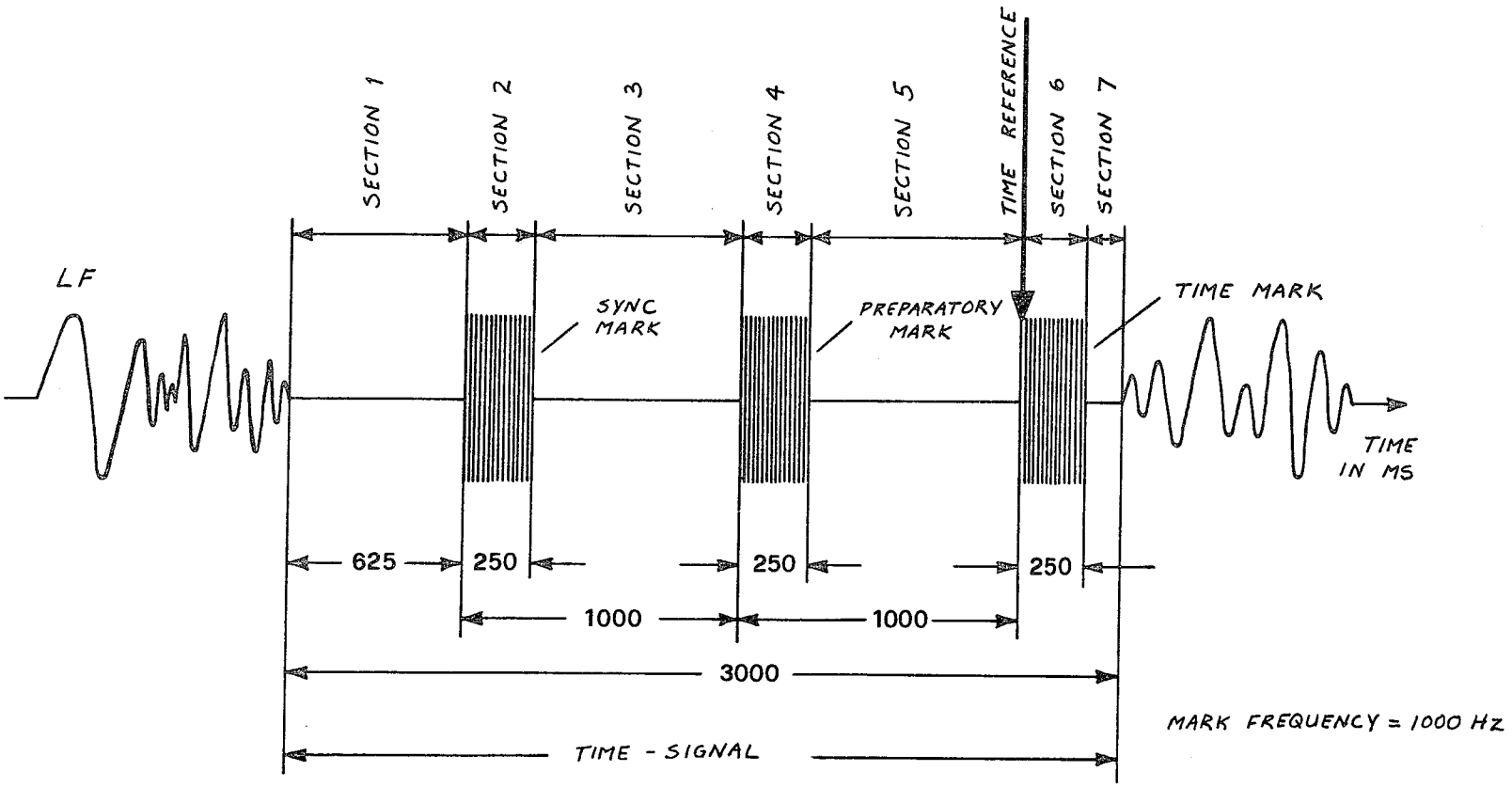
FIG. 9 shows an example of an appropriate time-signal for the method of this invention.

Adjustment at the transmitter end:

Automatic timing controls or readjustment steps for the self-contained radio-clocks must be designed and dimensioned for functioning under the worst operational conditions. A wide lock-in range, however, means a susceptibility to disturbances and a high amount of energy consumed by the clock, because the time-signal receiver is turned on for a longer period of time. At the present level of technology, excellent resonators can be produced to keep the daily rate deviations of a clock low. The highest deviation arises at a time scale jump, i.e., at leap or switchover seconds which a radio-clock must constantly take into account lest they degrade the whole conception. Hence it is advisable to partly depart from the method of leap seconds and to perform the adaptation of the mean solar time to the average atomic time in smaller time scale jumps. Advantageous is the splitting of the leap into 8 ($2^3$) equal parts, that is 0.125 second steps which are taken into consideration on 8 successive days before the calculated moment, the last calendar days of a UTC-month (UTC-=Coordinated Universal Time), preferably at the end of June or December. Here the general principle of the leap second internationally agreed upon is kept up. If more than one time-signal is transmitted per day (there should be 2 at least, displaced by 12 hours), then a time scale jump in each time-signal of a time interval (e.g. of one day) must be taken into consideration in the same way. Practical experience shows that one correction of the clock per day is sufficient. In order to tune out periodically interfering transmitters regularly interfering at the same time of the day it is advisable to fall back to a second time-signal. Another advantage of this is the independence of one particular time of the day when putting the clock into operation for the first time, or after a service. Hence all radio stations should oblige to always transmit the uniform time-signal at two fixed moments of the day displaced by 12 hours. From the various possibilities for an appropriate time-signal granting an automatic evaluation one solution has been worked out permitting the layout of simple time mark decoders and coders, being acoustically noticeable and having a duration of only 3 seconds (FIG. 9). The LF-modulation frequency of 1000 Hz was chosen because in communication engineering it serves as reference frequency for many parameters, and moreover can be made audible. The chosen duration of 3 seconds in all is an advantageous compromise between unnecessarily long (which means interference-prone) and too short (which means insufficient selection from an optional LF-signal). It must further be stressed that all decisive time intervals can be derived by binary dividers from a usual "clock frequency", e.g. $2^{15}$ Hz or $2^{22}$ Hz, for which sufficient resonators are available. This advantage is valid for both the time mark coder and decoder circuits. The equally selected time intervals cooperate to a computer evaluation, because then software loops or subroutines can be applied.

It will be understood that each of the elements described above may also find a useful application in other types of constructions differing from the types described above.

What is claimed as new and desired to be protected by Letters Patent is set forth in the appended claims:

1. A method of automatic adjustment, by means of a reference time mark which according to a time scale is periodically transmitted by a transmitter, of a self-contained radio-clock including an oscillator and a display, comprising the steps of deriving from the oscillator frequency a predetermined lock-in time range defining a lower limit and an upper limit which exceeds the range of the time mark; measuring periodically data relating to the deviation of the rate of the clock, such as the magnitude and direction of the deviation, by comparing the time marks with the periodic pulses from the clock; storing the measured deviation data for use to provide for correction of the clock rate of the clock in the event the time mark is missing and to provide for a validity check of the measured data; thereupon correcting the rate of the clock and the position of the display according to the stored deviation data without changing the stored data until the next time mark arrives.

2. A method as defined in claim 1, comprising correcting periodically the oscillator frequency according to the stored data.

3. A method as defined in claim 1, comprising the steps of switching on the time mark receiver shortly before the lower limit and switching off the receiver shortly after the upper limit of the lock-in range.

4. A method as defined in claim 1, comprising the steps of deriving periodic clock pulses from the oscillator frequency within the lock-in range, and automatically aligning the oscillator when the time mark is received within the lock-in range.

5. A method as defined in claim 1, wherein the time mark receiver is controlled by a computer to receive a time mark from the strongest transmitter and, in the event of a missing time mark, to tune up a next strongest transmitter or a preselected transmitter.

6. A method as defined in claim 1, wherein said time mark receiver includes a standard radio or television receiver, or the clock.

* * * * *